US012564767B2

(12) United States Patent
Mei

(10) Patent No.: US 12,564,767 B2
(45) Date of Patent: Mar. 3, 2026

(54) MOVABLE BALL CHAIR

(71) Applicants: NANTONG GEMKAL TECH CO., LTD, Nantong (CN); NANTONG HAWK FITNESS&SPORTS CO., LTD, Nantong (CN)

(72) Inventor: Fangfeng Mei, Nantong (CN)

(73) Assignees: NANTONG GEMKAL TECH CO., LTD, Nantong (CN); NANTONG HAWK FITNESS&SPORTS CO., LTD, Nantong (CN)

( * ) Notice: Subject to any disclaimer, the term of this patent is extended or adjusted under 35 U.S.C. 154(b) by 0 days.

(21) Appl. No.: 18/723,531

(22) PCT Filed: Dec. 20, 2022

(86) PCT No.: PCT/CN2022/140218
§ 371 (c)(1),
(2) Date: Jun. 24, 2024

(87) PCT Pub. No.: WO2024/082426
PCT Pub. Date: Apr. 25, 2024

(65) Prior Publication Data

US 2025/0242209 A1 Jul. 31, 2025

(30) Foreign Application Priority Data

Oct. 19, 2022 (CN) ..... 202222760349.8

(51) Int. Cl.
*A63B 41/00* (2006.01)
*A63B 21/055* (2006.01)
*A63B 21/16* (2006.01)

(52) U.S. Cl.
CPC ..... *A63B 41/125* (2020.08); *A63B 21/0557* (2013.01); *A63B 21/1609* (2015.10)

(58) Field of Classification Search
CPC . A63B 21/0557; A63B 21/1609; A63B 26/00; A63B 41/125; A63B 67/00; A63B 71/00
See application file for complete search history.

(56) References Cited

U.S. PATENT DOCUMENTS 7,044,558 B2 * 5/2006 Chiu ..... A47C 4/54 297/452.41
7,588,522 B2 * 9/2009 Heitzman ..... A47C 9/002 297/195.11

(Continued)

FOREIGN PATENT DOCUMENTS

CN 204427296 Y 7/2015
CN 208403768 Y 1/2019

(Continued)

OTHER PUBLICATIONS

International search report of PCT/CN2022/140218.

*Primary Examiner* — Joshua Lee
(74) *Attorney, Agent, or Firm* — Hemisphere Law, PLLC

(57) ABSTRACT

The present disclosure provides a movable ball chair, including an elastic ball and a support frame, wherein the support frame includes a plurality of connecting tubes bent downward and a plurality of supporting tubes bent upward, the supporting tubes and adjacent connecting tubes are connected end to end to form a three-dimensional closed loop in a manner that the included angles between planes of the supporting tubes and the planes of the adjacent connecting tubes are the same, the bottom of each supporting tube is provided with a connecting hole, the central axis L of the connecting hole is inclined from top to bottom toward the direction where the central axis L0 of the elastic ball in the vertical direction is located, the included angle between the central axis L of the connecting hole and the straight line Y is a°, the value range of a is 0.25-5, a sleeve assembly is welded to the interior of the connecting hole, the outside (Continued)

diameter of the sleeve assembly is matched with the inside diameter of the connecting hole, the sleeve assembly is provided with a through hole, the sleeve assembly is connected to a moving piece through the through hole, and the through hole, the sleeve assembly and the connecting hole are arranged coaxially. Free movement of the ball chair is achieved by the movable ball chair described in the present disclosure, and the movable ball chair has the advantages of simple and stable structure.

10 Claims, 9 Drawing Sheets

(56) References Cited

U.S. PATENT DOCUMENTS

| | | | | |
|---|---|---|---|---|
| 7,604,581 | B1 * | 10/2009 | Williams | A63B 21/0004 482/140 |
| D635,204 | S * | 3/2011 | Taylor | D21/662 |
| 8,056,976 | B1 * | 11/2011 | Polk | A47C 3/029 297/452.17 |
| 8,292,790 | B2 * | 10/2012 | Signorile | A63B 41/125 482/148 |
| 8,357,077 | B2 * | 1/2013 | Taylor | A63B 41/125 482/142 |
| 9,415,276 | B1 | 8/2016 | Hao | |
| 9,655,455 | B2 * | 5/2017 | Barnett | A47C 9/002 |
| 9,919,185 | B1 * | 3/2018 | Qiubo | A47C 9/002 |
| 10,021,983 | B2 * | 7/2018 | Mark | A47C 7/40 |
| 11,596,243 | B2 * | 3/2023 | Roberts | A47D 13/107 |
| RE49,499 | E * | 4/2023 | Chiu | A47C 3/30 482/112 |
| 2012/0299357 | A1 * | 11/2012 | Newman | A47C 4/54 297/452.41 |
| 2013/0154333 | A1 * | 6/2013 | Wu | A47C 4/03 297/452.23 |
| 2016/0236042 | A1 * | 8/2016 | Hao | A63B 26/003 |
| 2017/0120111 | A1 * | 5/2017 | Mcbride | A63B 43/002 |

FOREIGN PATENT DOCUMENTS

| | | |
|---|---|---|
| CN | 210159179 Y | 3/2020 |
| CN | 217409699 A | 9/2022 |

* cited by examiner

MOVABLE BALL CHAIR

TECHNICAL FIELD

The present disclosure relates to the field of sporting goods, in particular to a movable ball chair that can be used as both sporting goods and chairs.

BACKGROUND

A ball chair includes an elastic ball and a support frame arranged below the elastic ball for supporting the elastic ball. For example, a ball chair disclosed in the patent No. 201920216594.8 is formed by a plurality of bent connecting tubes and a plurality of bent supporting tubes to facilitate disassembly and transportation, but the ball chair formed is supported only at the bottom by an anti-slip block during use and cannot move freely.

SUMMARY

An object of the present disclosure is to provide a movable ball chair that solves one or more of the problems of the prior art described above.

The present disclosure provides a movable ball chair, including an elastic ball and a support frame, wherein the support frame includes a plurality of connecting tubes and a plurality of supporting tubes, the connecting tube and the supporting tube are both bent tubes, the supporting tube is bent upward, the connecting tube is bent downward, the supporting tubes and adjacent connecting tubes are connected end to end to form a three-dimensional closed loop in a manner that the included angles between planes where the supporting tubes are located and planes where the adjacent connecting tubes are located are the same, the bottom of each supporting tube is provided with a connecting hole, a central axis L of the connecting hole is inclined from top to bottom toward a direction where a central axis L0 of the elastic ball in a vertical direction is located, an included angle between the central axis L of the connecting hole and a straight line Y is a°, a value range of a is 0.25-5, a sleeve assembly is welded to the interior of the connecting hole, the outside diameter of the sleeve assembly is matched with the inside diameter of the connecting hole, the sleeve assembly is provided with a through hole, the sleeve assembly is connected to a moving piece through the through hole, and the through hole, the sleeve assembly and the connecting hole are arranged coaxially.

In some embodiments, the value range of a is 0.25-1.

In some embodiments, the number of the connecting tubes in the support frame is equal to the number of the supporting tubes, the number of the connecting tubes in one support frame is greater than or equal to 3, and the supporting tubes are uniformly distributed around the elastic ball circumferentially.

In some embodiments, the moving piece is a universal wheel, the universal wheel includes a universal wheel body and a connecting shaft arranged at the top of the universal wheel body, the connecting shaft is matched with the through hole, and the connecting shaft is inserted into the through hole of the sleeve assembly to be connected with the sleeve assembly.

In some embodiments, the sleeve assembly includes a cylindrical barrel and a bottom plate arranged at the bottom of the barrel, wherein the sleeve assembly is provided with a through hole running through the barrel and the bottom plate, the outside diameter of the barrel is matched with the inside diameter of the connecting hole, and the inner wall of the through hole is in threaded connection with the outer side wall of the connecting shaft.

In some embodiments, the outer surface of the barrel passing out of the connecting hole and the outer surface of the connecting shaft passing out of the barrel are both smooth.

In some embodiments, the sleeve assembly includes a barrel, a bottom plate arranged at the bottom of the barrel, and a nut, wherein the outside diameter of the barrel is matched with the inside diameter of the connecting hole, the sleeve assembly is provided with a through hole running through the barrel and the bottom plate, the inner wall of the through hole is in threaded connection with the outer side wall of the connecting shaft, the upper end of the barrel is provided with an auxiliary connecting segment, the outer side wall of the auxiliary connecting segment is in threaded connection with the nut, and the lower surface of the nut is in contact with the supporting tube.

In some embodiments, the outer surface of the barrel passing out of the connecting hole, the outer surface of the connecting shaft passing out of the barrel and the outer surface of the nut are all smooth.

In some embodiments, the sleeve assembly includes a barrel, a bottom plate arranged at the bottom of the barrel, and an acorn nut, wherein the outside diameter of the barrel is matched with the inside diameter of the connecting hole, the sleeve assembly is provided with a through hole running through the barrel and the bottom plate, the inner wall of the through hole is in threaded connection with the outer side wall of the connecting shaft, the upper end of the barrel is provided with an auxiliary connecting segment, the outer side wall of the auxiliary connecting segment and/or the outer side wall of the connecting shaft is in threaded connection with the acorn nut, and the lower surface of the acorn nut is in contact with the supporting tube.

In some embodiments, the length of the connecting shaft is greater than the length of the through hole, the end of the connecting shaft not connected with the universal wheel body passes out of the through hole, a thread on the outer side wall of the auxiliary connecting segment corresponds to a thread on the connecting shaft passing out of the through hole, a second acorn nut is adopted as the acorn nut, a first connecting groove and a second connecting groove which are arranged coaxially and communicate with each other are arranged in the second acorn nut, the inside diameter of the first connecting groove is greater than the inside diameter of the second connecting groove, the inner wall of the first connecting groove and the second connecting groove are provided with threads, the first connecting groove corresponds to the auxiliary connecting segment, and the second connecting groove corresponds to the connecting shaft passing out of the through hole.

The movable ball chair according to the present disclosure has the advantages that the movement of the ball chair is achieved, and the fluency during movement is ensured; the structure is simple, at the same time, the strength of connection between the moving piece and the support frame can be effectively ensured, thereby enhancing the overall stability of the movable ball chair.

Figure 1:
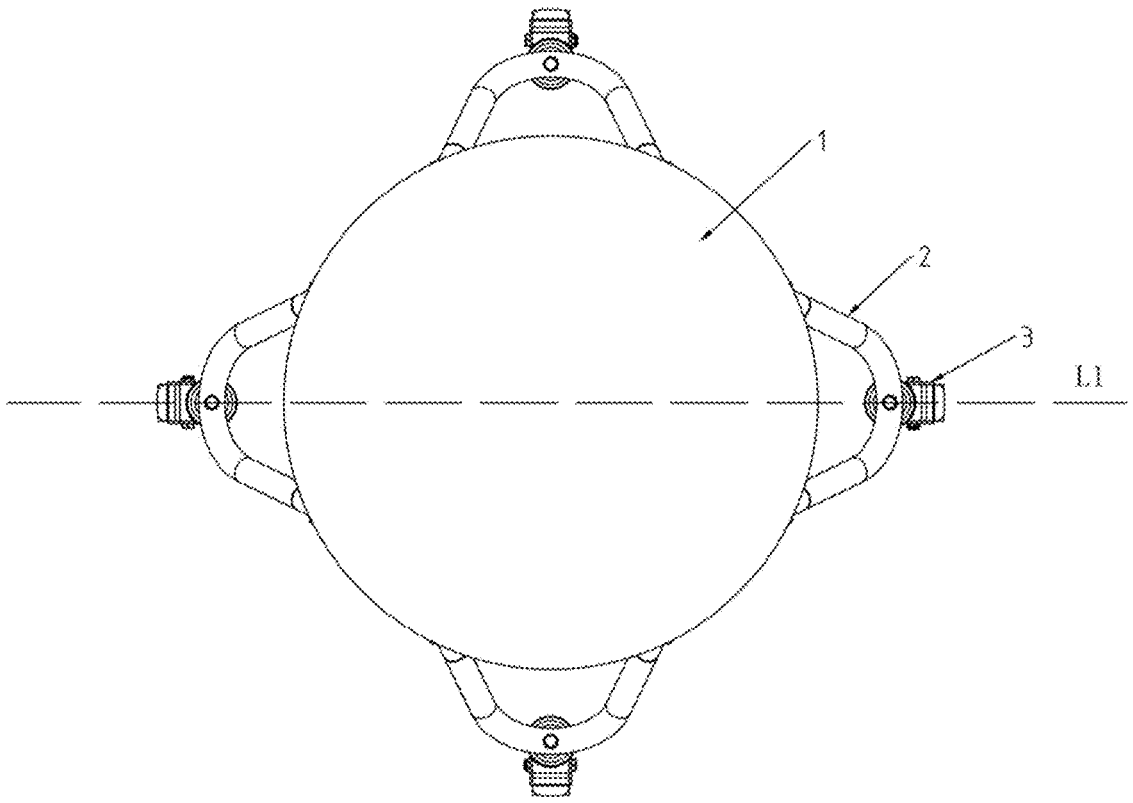
FIG. 1 is a top view of a movable ball chair according to some embodiments of the present disclosure.

In the drawings: 1, elastic ball, 2, support frame, 201, connecting tube, 202, spring pin, 203, supporting tube, 204, connecting hole, 3, universal wheel, 301, universal wheel body, 302, connecting shaft, 401, barrel, 402, bottom plate, 403, auxiliary connecting segment, 404, nut, 405, first acorn nut, 4051, first top surface, 406, second acorn nut, 4061, first connecting groove, 4062, second connecting groove, and 4063, second top surface.

DETAILED DESCRIPTION

The vertical direction refers to the direction perpendicular to the ground X when the movable ball chair is placed on the flat ground X.

Figure 2:
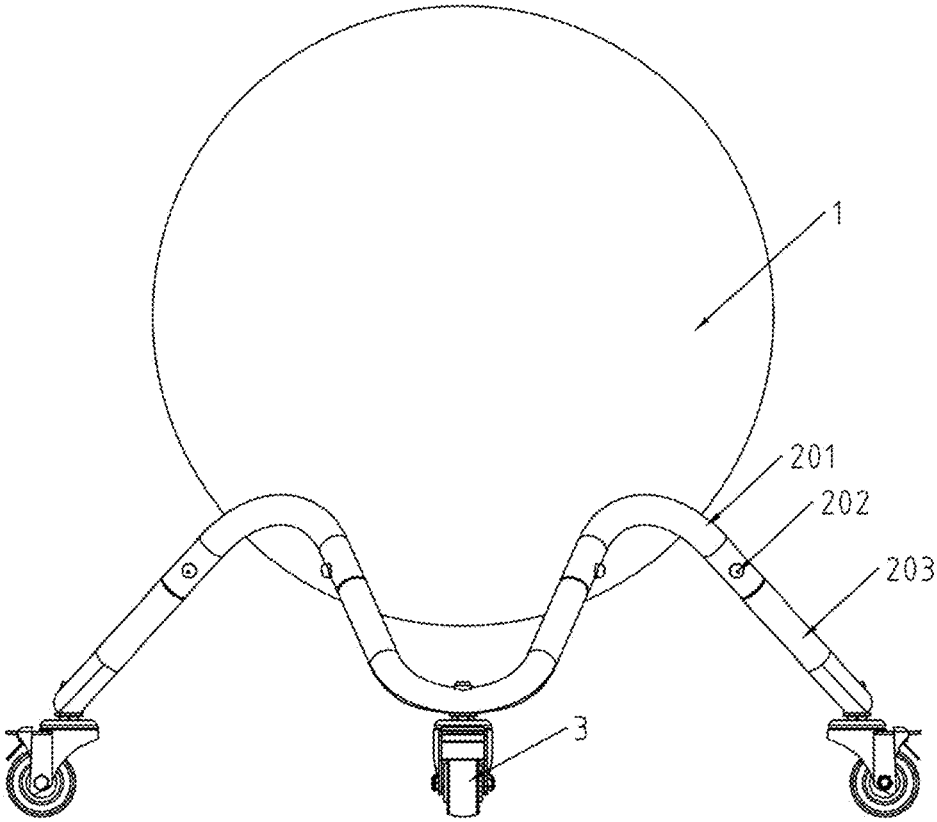
FIG. 2 is a front view of a movable ball chair according to some embodiments of the present disclosure.
Figure 3:
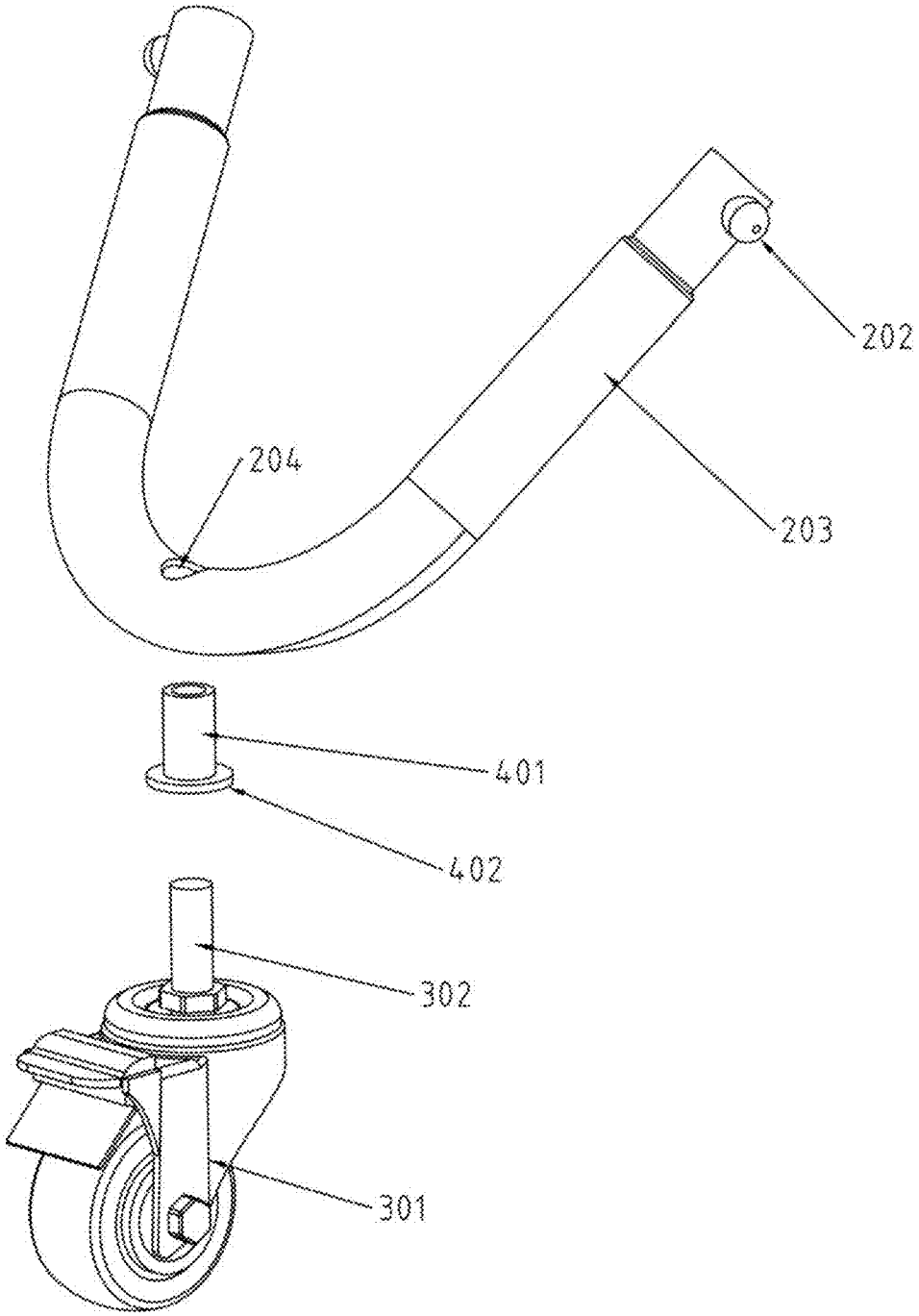
FIG. 3 is an exploded view of a moving part in Embodiment 1 of the present disclosure.
Figure 8:
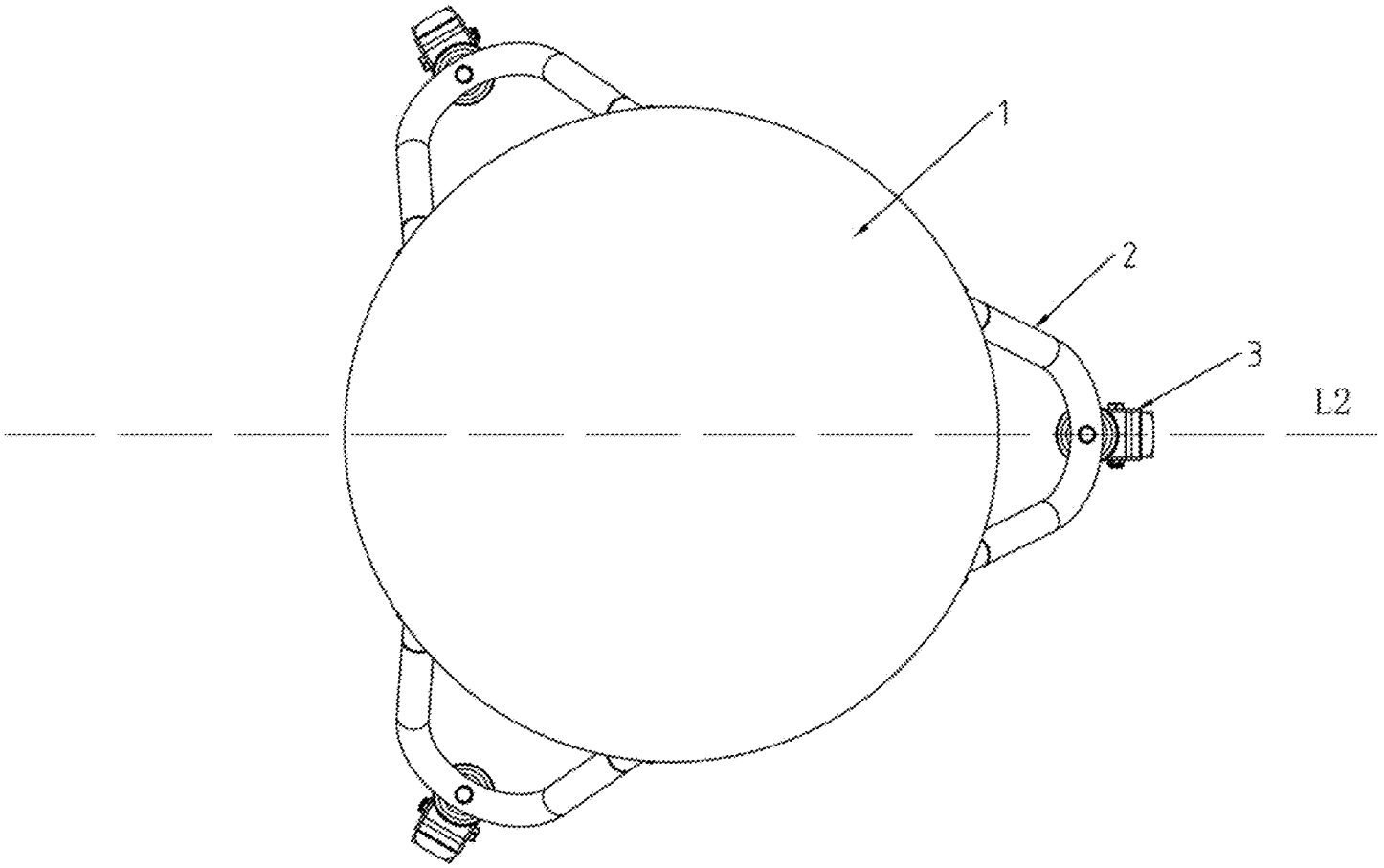
FIG. 8 is a top view of a movable ball chair according to other embodiments of the present disclosure.
Figure 9:
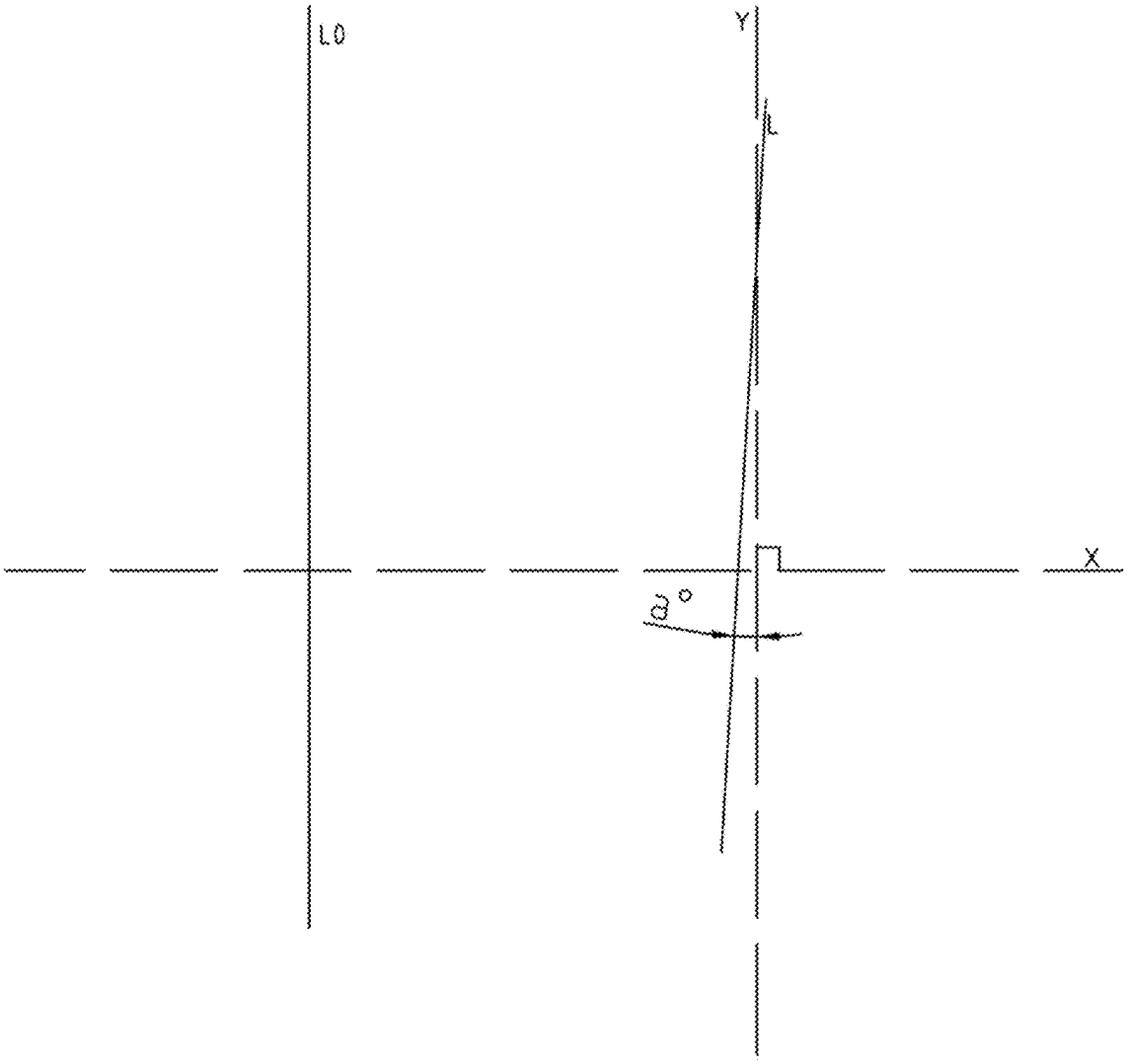
FIG. 9 is a schematic diagram of the relative position between the central axis of a connecting hole and the central axis of an elastic ball in some embodiments of the present disclosure.

As shown in FIGS. 1 to 9, a movable ball chair is disclosed and includes an elastic ball 1 and a support frame 2, wherein the support frame 2 includes a plurality of connecting tubes 201 and a plurality of supporting tubes 203, both the connecting tube 201 and the supporting tube 203 are bent tubes, the supporting tube 203 is bent upward, the connecting tube 201 is bent downward, the supporting tubes 203 and adjacent connecting tubes 201 are connected end to end to form a three-dimensional closed loop in a manner that the included angles between the planes where the supporting tubes are located and the planes where the adjacent connecting tubes are located are the same (two ends of the supporting tube 203 are each provided with one first connecting part, the side wall of each first connecting part is provided with a spring pin 202, the two ends of the connecting tube 201 are each provided with one second connecting part, the side wall of each second connecting part is provided with a pin hole corresponding to the spring pin 202, the supporting tube 203 can be connected to the connecting tube 201 by inserting the first connecting part into the second connecting part and inserting the spring pin 202 into the pin hole, and all the supporting tubes 203 and adjacent connecting tubes 201 are connected end to end to form a three-dimensional closed loop in this way), the bottom of each supporting tube 203 is provided with a connecting hole 204, the central axis L of the connecting hole 204 is inclined from top to bottom toward the direction where the central axis L0 of the elastic ball 1 in the vertical direction is located, and the included angle between the central axis L of the connecting hole 204 and the straight line Y is a°, wherein the value range of a is 0.25-5. A sleeve assembly is welded to the interior of the connecting hole 204, the outside diameter of the sleeve assembly is matched with the inside diameter of the connecting hole 204, the sleeve assembly is provided with a through hole, the sleeve assembly is connected to a moving piece through the through hole, and the through hole, the sleeve assembly and the connecting hole 204 are arranged coaxially. The number of the connecting tubes 201 in the support frame 2 is equal to the number of the supporting tubes 203, the number of the connecting tubes 201 in one support frame 2 is greater than or equal to 3, and the supporting tubes 203 are uniformly distributed around the elastic ball 1 circumferentially. For example:

- as shown in FIG. 1 and FIG. 2, the supporting frame 2 includes four connecting tubes 201 and four supporting tubes 203, and the movable ball chair formed by combining the supporting frame 2 and the elastic ball 1 is symmetrically distributed about the centerline L1 of any two opposite supporting tubes 203;
- as shown in FIG. 8, the support frame 2 includes three connecting tubes 201 and three supporting tubes 203, and the movable ball chair formed by combining the support frame 2 and the elastic ball 1 is symmetrically distributed about the centerline L2 of any one of the supporting tubes 203.

The moving piece is a universal wheel 3, the universal wheel 3 includes a universal wheel body 301 and a connecting shaft 302 arranged at the top of the universal wheel body 301, the connecting shaft 302 is matched with the through hole, and the connecting shaft 302 is inserted into the through hole of the sleeve assembly to be connected with the sleeve assembly. Due to the position design of the through hole, the sleeve assembly and the connecting hole mentioned above, the probability of the universal wheel jamming caused during movement of the movable ball chair can be effectively reduced.

In some specific embodiments, the value range of a is 0.25-1.

Embodiment 1

As shown in FIGS. 1-3 and 8, the sleeve assembly in the movable ball chair includes a cylindrical barrel 401 and a bottom plate 402 arranged at the bottom of the barrel 401, wherein the sleeve assembly is provided with a through hole running through the barrel 401 and the bottom plate 402, the outside diameter of the barrel 401 is matched with the inside diameter of the connecting hole 204, and the inner wall of the through hole is in threaded connection with the outer side wall of the connecting shaft 302. The bottom surface of the bottom plate 402 is attached to the top of the universal wheel body 301 after the universal wheel 3 is connected to the support frame.

In some specific implementations of this embodiment during concrete implementation, the phenomenon that the barrel 401 passes out of the connecting hole 204 and/or the connecting shaft 302 passes out of the barrel 401 may occur, and the outer surface of the barrel 401 passing out of the connecting hole 204 and the outer surface of the connecting shaft 302 passing out of the barrel 401 are both smooth, so as to prevent the sleeve assembly part passing out of the connecting hole 204 and the connecting shaft part from scratching or snagging other parts such as a chair cover for covering the movable ball chair, and clothes of a person using the movable ball chair.

In some specific embodiments, the upper end of the connecting shaft 302 passes out of the barrel 401, and a nut is arranged on the part, passing out of the barrel 401, of the connecting shaft 302, thereby further ensuring the strength of connection between the moving piece and the support frame by means of the threaded connection between the nut and the connecting shaft 302.

Embodiment 2

Figure 4:
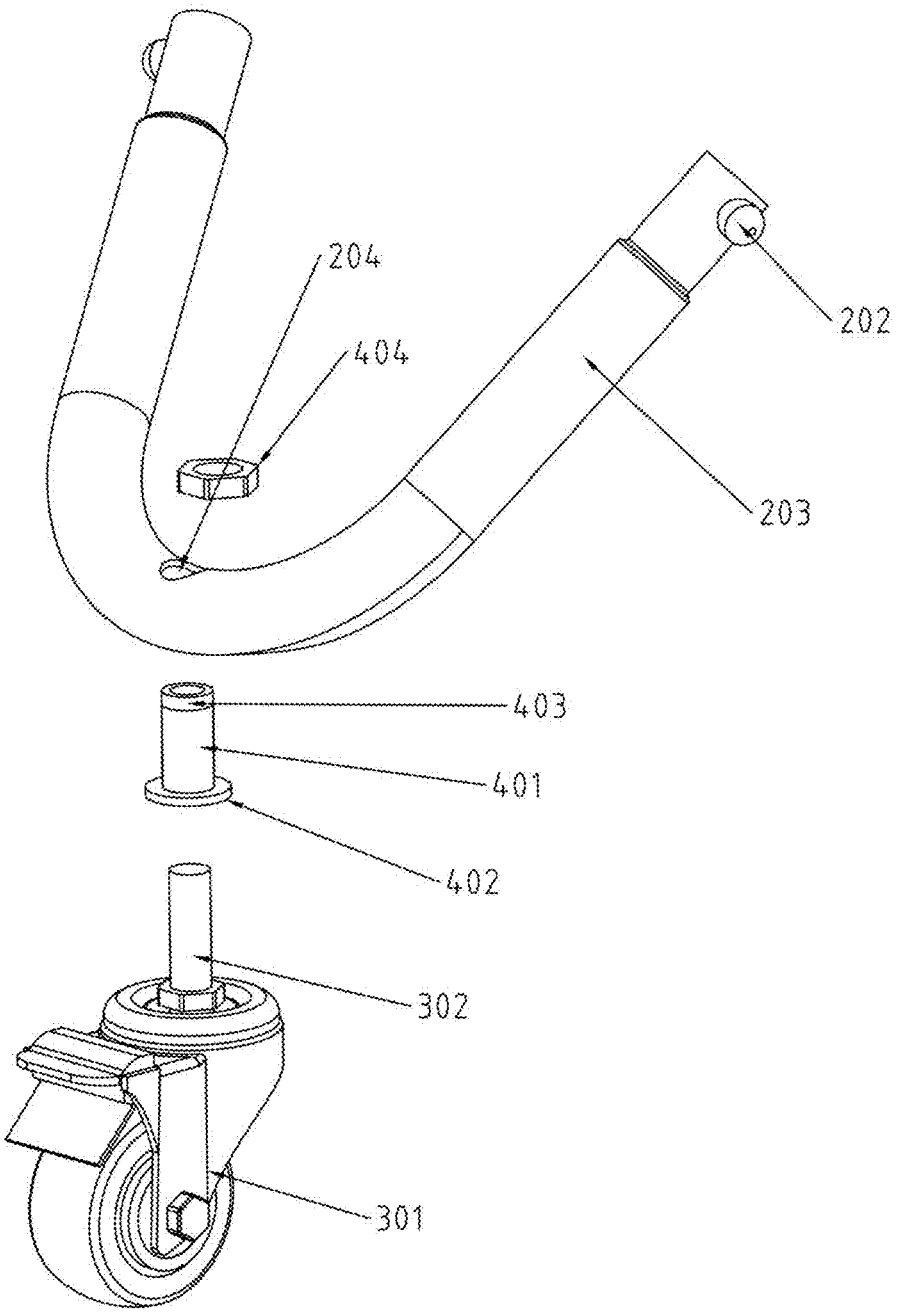
FIG. 4 is an exploded view of a moving part in Embodiment 2 of the present disclosure.

As shown in FIG. 4, the sleeve assembly in the movable ball chair includes a barrel 401, a bottom plate 402 arranged at the bottom of the barrel 401, and a nut 404, wherein the outside diameter of the barrel 401 is matched with the inside diameter of the connecting hole 204, the sleeve assembly is provided with a through hole running through the barrel 401 and the bottom plate 402, the inner wall of the through hole is in threaded connection with the outer side wall of the connecting shaft 302, the upper end of the barrel 401 is provided with an auxiliary connecting segment 403, the auxiliary connecting segment 403 at the upper end of the barrel 401 is exposed after the barrel 401 passes out of the connecting hole 204, the outer side wall of the auxiliary connecting segment 403 is in threaded connection with the nut 404, and the lower surface of the nut 404 is in contact with the supporting tube 203.

In some specific implementations of this embodiment during concrete implementation, after the moving piece is connected to the support frame, the bottom surface of the bottom plate 402 is attached to the top of the universal wheel body 301. Preferably, the upper surface of the connecting shaft 302 is flush with the upper surface of the barrel 401 and has a height of less than or equal to the height of the upper surface of the nut. The upper surface of the connecting shaft 302, the upper surface of the barrel 401 and the outer surface of the nut are all smooth.

If the height of the upper surface of the connecting shaft 302 is greater than the height of the upper surface of the barrel 401, and/or if the height of the upper surface of the barrel 401 is greater than the height of the upper surface of the nut, the outer surface of the barrel 401 passing out of the connecting hole 204, the outer surface of the connecting shaft 302 passing out of the barrel 401, and the outer surface of the nut 404 are all smooth, so as to prevent the sleeve assembly part passing out of the connecting hole 204 and the connecting shaft part from scratching or snagging other parts such as a chair cover for covering the movable ball chair, and clothes of a person using the movable ball chair.

The strength of connection between the sleeve assembly and the support frame is further enhanced by the arrangement of the nut 404.

Embodiment 3

Figure 5:
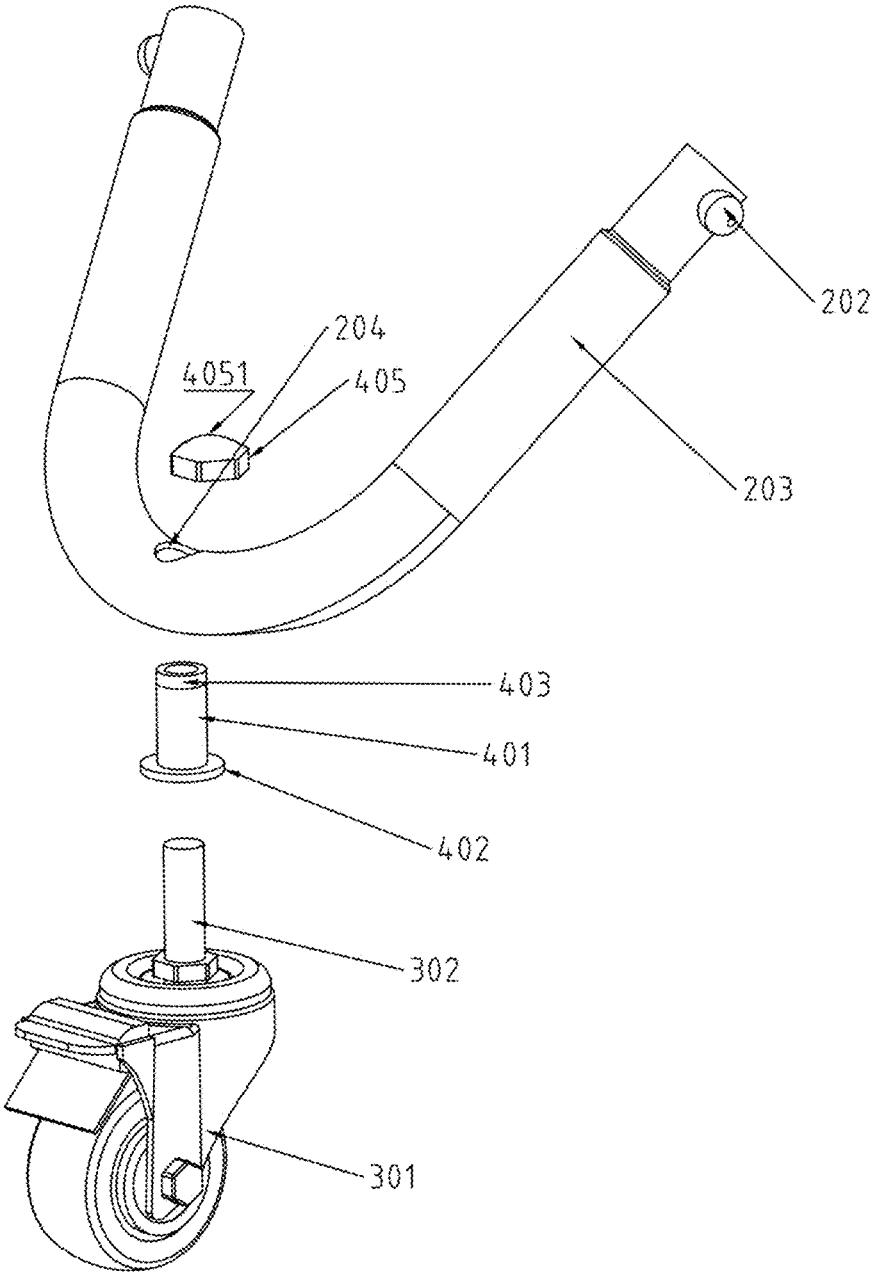
FIG. 5 is an exploded view of a moving part in Embodiment 3 of the present disclosure.

As shown in FIG. 5, the sleeve assembly in the movable ball chair includes a barrel 401, a bottom plate 402 arranged at the bottom of the barrel 401, and a first acorn nut 405, wherein the sleeve assembly is provided with a through hole running through the barrel 401 and the bottom plate 402, the inner wall of the through hole is in threaded connection with the outer side wall of the connecting shaft 302, the height of the connecting shaft 302 is less than or equal to the height of the through hole (i.e., the height of the upper surface of the connecting shaft 302 is less than the height of the upper surface of the barrel 401 after the universal wheel is connected with the support frame), the upper end of the barrel 401 is provided with an auxiliary connecting segment 403, the auxiliary connecting segment 403 at the upper end of the barrel 401 is exposed after the barrel 401 passes out of the connecting hole 204, the outer side wall of the auxiliary connecting segment 403 is in threaded connection with the first acorn nut 405, and the lower surface of the acorn nut is in contact with the supporting tube 203.

A first top surface 4051 of the first acorn nut may be a spherical surface, the top of the first acorn nut may also be provided with other parts with smooth surfaces (e.g., a cartoon character having a smooth surface formed on the top of the acorn nut to enhance the aesthetics of the first acorn nut while ensuring a connection effect), and the outer side face of the first acorn nut is smooth.

The exposed barrel 401 is hidden by the first acorn nut 405 to enhance the aesthetics, while the strength of connection between the sleeve assembly and the support frame is further enhanced by the arrangement of the first acorn nut 405.

Embodiment 4

Figure 6:
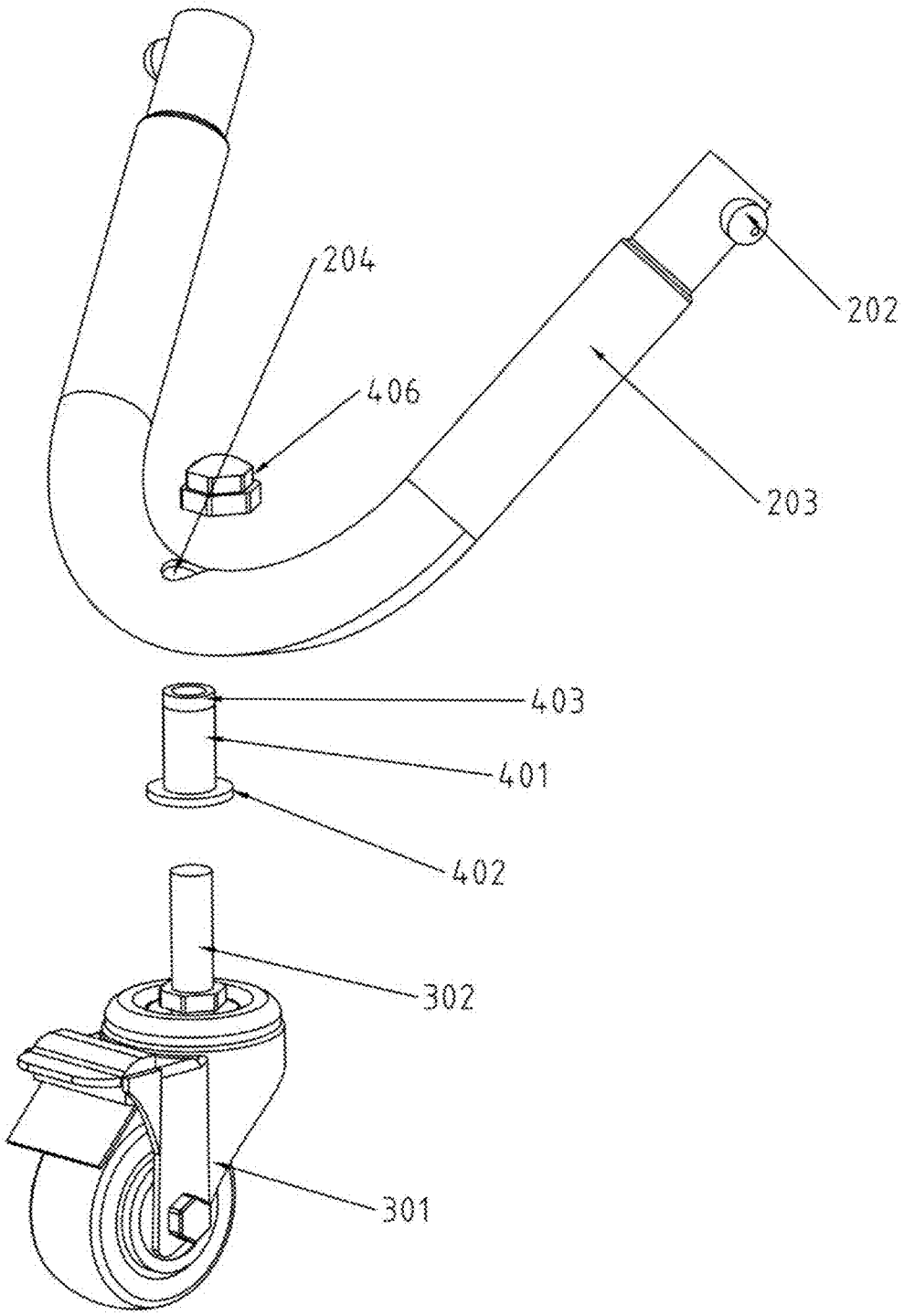
FIG. 6 is an exploded view of a moving part in Embodiment 4 of the present disclosure.
Figure 7:
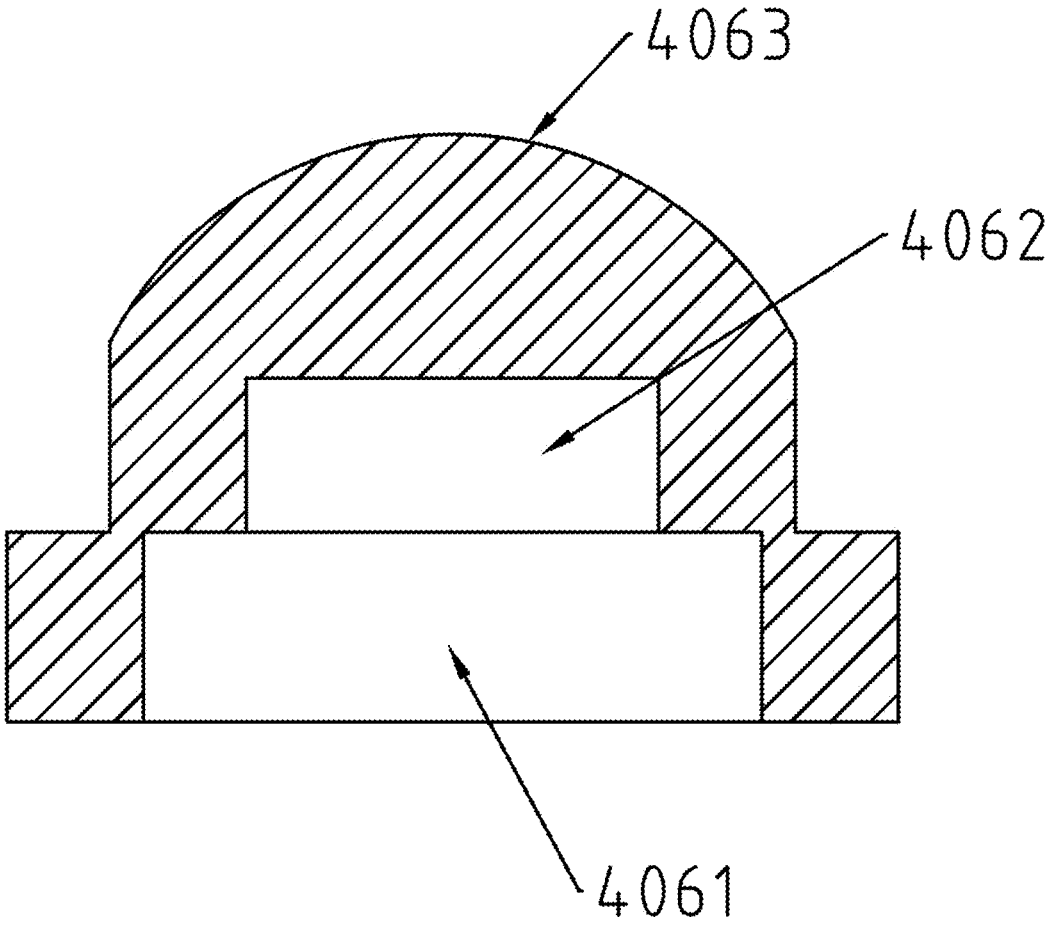
FIG. 7 is a schematic sectional view of an auxiliary nut in Embodiment 4 of the present disclosure.

As shown in FIG. 6, the sleeve assembly in the movable ball chair includes a barrel 401, a bottom plate 402 arranged at the bottom of the barrel 401, and a second acorn nut 406, wherein the sleeve assembly is provided with a through hole running through the barrel 401 and the bottom plate 402, the inner wall of the through hole is in threaded connection with the outer side wall of the connecting shaft 302, the length of the connecting shaft 302 is greater than the length of the through hole, the end of the connecting shaft 302 not connected with the moving piece passes out of the through hole after the universal wheel is connected with the supporting frame, the upper end of the barrel 401 is provided with an auxiliary connecting segment 403, the auxiliary connecting segment 403 at the upper end of the barrel 401 is exposed after the barrel 401 passes out of the connecting hole 204, and the thread on the outer side wall of the auxiliary connecting segment 403 corresponds to the thread on the connecting shaft 302 passing out of the through hole, so as to ensure that both the outer side wall of the auxiliary connecting segment 403 and the outer side wall of the connecting shaft 302 can be in threaded connection with the second acorn nut 406. The lower surface of the second acorn nut 406 is in contact with the supporting tube 203, a first connecting groove 4061 and a second connecting groove 4062 which are arranged coaxially and communicate with each other are arranged in the second acorn nut 406, the inside diameter of the first connecting groove 4061 is greater than the inside diameter of the second connecting groove 4062, the inner wall of the first connecting groove 4061 and the second connecting groove 4062 are provided with threads, the first connecting groove 4061 corresponds to the auxiliary connecting segment 403, and the second connecting groove 4062 corresponds to the connecting shaft 302 passing out of the through hole.

A second top surface 4063 at the top of the second acorn nut may be a spherical surface, the top of the second acorn nut may also be provided with other parts with smooth surfaces (e.g., a cartoon character having a smooth surface formed on the top of the second acorn nut to enhance the aesthetics of the first acorn nut while ensuring a connection effect), and the outer side face of the second acorn nut is smooth.

The exposed barrel 401 and connecting shaft 302 are hidden by the second acorn nut 406 to enhance the aesthetics, while the strength of connection between the sleeve assembly and the support frame is further enhanced by the arrangement of the second acorn nut 406.

In the sleeve assembly described in Embodiments 2-4, the outer wall of the barrel 401 may be connected and fixed only by using the bottom plate 402 and any one of the nut, the first acorn nut and the second acorn nut at the top of the barrel 401 instead of welding technology, and this connection and fixing means can be realized by using the prior art, so the details are not repeated here.

In the specific use process of the movable ball chair, the elastic ball 1 is stressed, so that a downward force will be applied to the support frame 2. According to the design of the included angle between the central axis L of the connecting hole 204 and the straight line Y, after a force is applied, the state of the central axis of the connecting hole 204 will change with the bottom inclining outward, so that the central axis L of the connecting hole 204 tends to be parallel to the straight line Y, the universal wheel can be effectively guaranteed to slide smoothly and freely, and the error generated in the splicing process of the support frame can be reduced.

While the foregoing is merely a preferred embodiment of the present disclosure, it should be noted that numerous similar variations and modifications may be made by those skilled in the art without departing from the inventive concepts herein, and these should be considered to be within the scope of the present disclosure.

What is claimed is:

1. A movable ball chair, comprising an elastic ball (1) and a support frame (2), wherein the support frame (2) comprises a plurality of connecting tubes (201) and a plurality of supporting tubes (203), each connecting tube (201) and each supporting tube (203) are bent tubes, each supporting tube (203) is bent upward, each connecting tube (201) is bent downward, the supporting tubes (203) and adjacent connecting tubes are connected end to end to form a three-dimensional closed loop in a manner that included angles between planes where the supporting tubes are located and planes where the adjacent connecting tubes are located are the same, the bottom of each supporting tube (203) is provided with a connecting hole (204), a central axis L of the connecting hole (204) is inclined from top to bottom toward a direction where a central axis L0 of the elastic ball (1) in a vertical direction is located, an included angle between the central axis L of the connecting hole (204) and a straight line Y is a°, a value range of a is 0.25-5, a sleeve assembly is welded to the interior of the connecting hole (204), an outside diameter of the sleeve assembly is matched with an inside diameter of the connecting hole (204), the sleeve assembly is provided with a through hole, the sleeve assembly is connected to a moving piece through the through hole, and the through hole, the sleeve assembly and the connecting hole (204) are arranged coaxially.

2. The movable ball chair according to claim 1, wherein the value range of a is 0.25-1.

3. The movable ball chair according to claim 1, wherein the number of the connecting tubes (201) in the support frame (2) is equal to the number of the supporting tubes (203), the number of the connecting tubes (201) in the support frame (2) is greater than or equal to 3, and the supporting tubes (203) are uniformly distributed around the elastic ball (1) circumferentially.

4. The movable ball chair according to claim 1, wherein the moving piece is a universal wheel (3), the universal wheel (3) comprises a universal wheel body (301) and a connecting shaft (302) arranged at the top of the universal wheel body (301), the connecting shaft (302) is matched with the through hole, and the connecting shaft (302) is inserted into the through hole of the sleeve assembly to be connected with the sleeve assembly.

5. The movable ball chair according to claim 4, wherein the sleeve assembly comprises a cylindrical barrel (401) and a bottom plate (402) arranged at the bottom of the barrel (401), wherein the sleeve assembly is provided with a through hole running through the barrel (401) and the bottom plate (402), an outside diameter of the barrel (401) is matched with the inside diameter of the connecting hole (204), and an inner wall of the through hole is in threaded connection with an outer side wall of the connecting shaft (302).

6. The movable ball chair according to claim 5, wherein an outer surface of the barrel (401) passing out of the connecting hole (204) and an outer surface of the connecting shaft (302) passing out of the barrel (401) are both smooth.

7. The movable ball chair according to claim 4, wherein the sleeve assembly comprises a barrel (401), a bottom plate (402) arranged at the bottom of the barrel (401), and a nut (404), wherein an outside diameter of the barrel (401) is matched with the inside diameter of the connecting hole (204), the sleeve assembly is provided with a through hole running through the barrel (401) and the bottom plate (402), an inner wall of the through hole is in threaded connection with an outer side wall of the connecting shaft (302), an upper end of the barrel (401) is provided with an auxiliary connecting segment (403), an outer side wall of the auxiliary connecting segment (403) is in threaded connection with the nut (404), and a lower surface of the nut (404) is in contact with a corresponding supporting tube (203).

8. The movable ball chair according to claim 7, wherein an outer surface of the barrel (401) passing out of the connecting hole (204), an outer surface of the connecting shaft (302) passing out of the barrel (401) and an outer surface of the nut (404) are all smooth.

9. The movable ball chair according to claim 4, wherein the sleeve assembly comprises a barrel (401), a bottom plate (402) arranged at the bottom of the barrel (401), and an acorn nut, wherein an outside diameter of the barrel (401) is matched with the inside diameter of the connecting hole (204), the sleeve assembly is provided with a through hole running through the barrel (401) and the bottom plate (402), an inner wall of the through hole is in threaded connection with an outer side wall of the connecting shaft (302), an upper end of the barrel (401) is provided with an auxiliary connecting segment (403), an outer side wall of the auxiliary connecting segment (403) and/or the outer side wall of the connecting shaft (302) is in threaded connection with the acorn nut, and a lower surface of the acorn nut is in contact with a corresponding supporting tube (203).

10. The movable ball chair according to claim 9, wherein a length of the connecting shaft (302) is greater than a length of the through hole, an end of the connecting shaft (302) not connected with the universal wheel body (301) passes out of the through hole, a thread on the outer side wall of the auxiliary connecting segment (403) corresponds to a thread on the connecting shaft (302) passing out of the through hole, a second acorn nut (406) is adopted as the acorn nut, a first connecting groove (4061) and a second connecting groove (4062) which are arranged coaxially and communicate with each other are arranged in the second acorn nut (406), an inside diameter of the first connecting groove (4061) is greater than an inside diameter of the second connecting groove (4062), an inner wall of the first connecting groove (4061) and the second connecting groove (4062) are provided with threads, the first connecting groove (4061) corresponds to the auxiliary connecting segment (403), and the second connecting groove (4062) corresponds to the connecting shaft (302) passing out of the through hole.

* * * * *